United States Patent [19]

Hagopian

[11] 4,334,396

[45] Jun. 15, 1982

[54] INTERCONNECTING LOCK CONSTRUCTION FOR SIDING, SOFFITS AND RELATED CONSTRUCTION ELEMENTS

[75] Inventor: John G. Hagopian, New Philadelphia, Ohio

[73] Assignee: The Anaconda Company, New York, N.Y.

[21] Appl. No.: 38,561

[22] Filed: May 15, 1979

Related U.S. Application Data

[63] Continuation-in-part of Ser. No. 910,756, May 30, 1978, abandoned.

[51] Int. Cl.[3] ..... E04C 2/38; E04C 2/40

[52] U.S. Cl. ..... 52/522; 52/521; 52/545; 52/549

[58] Field of Search ..... 52/521, 545, 546, 549, 52/527, 529, 522

[56] References Cited

U.S. PATENT DOCUMENTS

| | | | |
|---|---|---|---|
| 3,110,130 | 11/1963 | Trachtenberg | 52/520 X |
| 3,120,082 | 2/1964 | Mendelsohn | 52/531 |
| 3,150,464 | 9/1964 | Shmitt | 52/520 X |
| 3,233,382 | 2/1966 | Graveley, Jr. | 52/527 X |
| 3,289,365 | 12/1966 | McLaughlin et al. | 52/522 X |
| 3,325,952 | 6/1967 | Trachtenberg | 52/522 X |
| 3,504,467 | 4/1970 | Hatch et al. | 52/521 X |

*Primary Examiner*—Carl D. Friedman

*Attorney, Agent, or Firm*—Pennie & Edmonds

[57] ABSTRACT

A panel (10, 60) applicable to siding, soffits and related construction elements used as coverings for houses, buildings and like structures includes new, improved intercooperating gripping portions (18, 28 and 62, 64) at first (16) and second (26) edges for effectively locking panels of successive courses. The gripping portion at the first edge comprises a nail hem of double thickness for nailing the panel to an adjacent structure and there is an insulative layer (66) providing a wind resistance medium.

11 Claims, 8 Drawing Figures

INTERCONNECTING LOCK CONSTRUCTION FOR SIDING, SOFFITS AND RELATED CONSTRUCTION ELEMENTS

DESCRIPTION

CROSS-REFERENCE TO RELATED APPLICATION

This application is a continuation-in-part of application Ser. No. 910,756, filed May 30, 1978 abandoned.

TECHNICAL FIELD

A panel for siding, soffit and other construction includes a first edge having a folded hem with a terminally disposed lock or gripping member, and an opposite second edge, also having a terminally disposed lock or gripping member. Adjacent panels may be locked in successive courses by securing the lock or gripping member at the second edge of an upper panel within the lock or gripping member at the first edge of the lower panel. The folded hem provides a location for nailing the upper panel to a substrate, once secured. Insulative means is provided substantially throughout the surface of the panel facing the substrate which may be the structure of a house, building or like structure, and serves as a barrier to the flow of air.

Background Art

The prior art is replete with panels for siding, soffit and other construction for application to a home, building or like structure in order to provide a long-lasting, high-wearing ornamental surface. Typically, these panels include intricate mating surfaces at oppositely disposed first and second edges whereby panels of siding are applied to the substrate which may be a wall in successive courses beginning at the bottom. To this end, the mating surface at the second or lower edge of an upper panel is received by the mating surface at the first or upper edge of a lower panel, and so on until the top of the wall is reached.

One prior art panel is disclosed by U.S. Pat. No. 2,739,676 to T. Tomita. In Tomita, the upper edge of each panel is formed with a portion retroverted forwardly or away from the substrate. This portion overlies a portion of the panel area and is integral with a forwardly extending horizontal length and an upwardly extending flange, providing what may be characterized as a "tongue". The panel may be secured to an established structure by nails passed through the retroverted portion, and the tongue supports a mating, similarly configurated surface or "groove" at the lower edge of the panel of the next higher course of panels. Another variation of panel known to the prior art is that disclosed in U.S. Pat. No. 3,504,467 to D. K. Hatch et al. Hatch et al describe a panel having overlapping and interlocking structure wherein a flange extending from a rib is provided to receive nails and secure the panel to an established structure. The rib is configured to define a pocket to serve as the mating configuration for receiving a flange of an adjacent panel.

Another panel and structure to provide locking, snap-acting mating engagement is disclosed in U.S. Pat. No. 3,325,952 to S. Z. Trachtenberg. Trachtenberg discloses a panel having an upper edge portion retroverted forwardly, providing a nail hem, and a depending reversely curved longitudinal length. The Trachtenberg panel, further, includes a reversely curved longitudinal length at the lower edge complementary in outline to that of the reversely curved longitudinal length at the upper edge. The two curved portions are described to provide a lock as courses of siding are applied from the bottom to the top of a wall.

Various additional structures are disclosed in the prior art, as follows U.S. Pat. Nos.:

3,110,130—S. Z. Trachtenberg
3,120,082—B. E. Mendelsohn
3,150,464—S. Shmitt
3,159,943—B. L. Sugar et al
3,188,774—C. McCorkle
3,218,772—L. Martin
3,233,382—R. L. Graveley, Jr.
3,289,365—E. R. McLaughlin et al
3,977,145—G. B. Dobby et al Of the prior art, above, the patents to Mendelsohn, Sugar et al, Graveley, Jr. and McLaughlin et al generally are similar in that each discloses a panel having a locking element at the upper edge and a lip at the lower edge for interengagement of the courses of panels from the bottom to the top of a wall. In each of Mendelsohn, Sugar et al and McLaughlin et al, the locking element is in the form of a forwardly and downwardly directed tongue connecting the major surface area of the panel with a hem including spaced nail holes for supporting the panel on the wall. The nail hem is of a single thickness. Graveley, Jr. describes the locking element as a downturned wall with an outwardly turned rib at the end. Graveley, Jr. describes the rib as imparting additional longitudinal rigidity to the panel.

The patents to Trachtenberg 3,110,130, Shmitt, McCorkle, Martin and Dobby et al, of general interest of the state of the art, disclose panels employing additional attaching means, such as the clip of Trachtenberg 3,110,130 for joining adjacent panels in the siding of an established structure.

Typically, the prior art panels suffer from various problems and disadvantages which include, among others, problems and disadvantages incident to their design. In one regard, depending upon whether the panel is formed of plastic or metal, the panel ordinarily is extruded or rolled or otherwise fabricated in widths significantly wider than that width required to produce a panel capable of providing conventional coverage. To this end, referring to one width of coverage, the design and configuration has required a strip of approximately 10.5 inches in width or greater to produce a panel having an effective coverage of 8 inches in width. Thus, about 76% of the material used in preparing the panel is used to cover the surface, while the remaining 24% is utilized in securing one course of panel to another and to the wall upon which it is supported. This consideration applies to other width panels as well.

As an incident to the above and so as not to increase the area of the panel which provides no additional effective surface coverage, many panels of the prior art include only a single thickness of material in the region of the nail hem and, thus, only a single thickness of material is utilized in supporting the panel to the wall.

The panels disclosed by Mendelsohn, Sugar et al, and McLaughlin et al are typical of the prior art panels as described above, including a nail hem of a single thickness of material and wherein the fabricated width appears substantially in excess of that required for effective coverage of wall surface.

The Graveley, Jr. patent also provides a nail hem formed by only a single thickness of material.

A further problem and disadvantage of certain prior art panels is in the construction of the lock comprised of the gripping portions at the oppositely disposed first and second edges of successive panels which are interengaged as a panel of an upper course is received by a panel of a lower course. To this end, panels of the prior art often include a uniquely configurated or intricate gripping portion at a first or upper edge and a complementary gripping portion at the lower edge thereby to interengage successive panels. Oftentimes, these complementary configurated gripping portions prevent adjustment of panels horizontally as may be necessary in installation because of friction developed between the surfaces. Also, it is common that the gripping portions do not provide for the vertical support of the panel of the upper course until that panel actually is nailed to the wall. The Tomita, Hatch et al and Trachtenberg 3,325,952 patents are typical of this segment of the prior art. Further, the gripping portions of the panels, quite often, are subject to fatigue thereby to militate against disengagement of once engaged panels. Further still, if it happens that the installer is not accurate in driving nails through openings in the nail hem and by chance strikes the gripping portion at the first edge of the panel, the gripping portion may be so deformed so as to prevent or make it difficult to engage the complementary configurated gripping portion at the second edge of the successive panel. The difficulty in engagement may result in a marring of the surface of a panel upon otherwise unnecessary manipulation of the successive panel to lock it to the adjacent panel. Marring of panels also may result if the manner of gripping requires that a gripping portion of the upper panel be received in a restricted opening of the gripping portion of the lower panel.

DISCLOSURE OF THE INVENTION

It has now been found that, by practice of the present invention, there is provided a new, improved construction applicable to siding, soffit and other panels (hereafter "panel") including oppositely disposed gripping portions to effectively secure adjacent panels or panels of successive courses of panels when positioned on a surface of an existing structure. Also, the gripping portions effectively serve to secure adjacent panels notwithstanding surface defects which may result during installation and the panels of siding are effectively supported vertically prior to the completion of mounting by nailing.

The present invention, generally stated, relates to a new, improved panel having an overlapping edge folded to configurate a double thickness nailing hem and a terminally disposed gripping portion which effectively secures a mating gripping portion of an adjacent structure. The first-mentioned gripping portion is located at a first edge of the panel and the last-mentioned gripping portion is located at a second edge of the panel. The double thickness of nailing hem effectively strengthens the fastening of panel to the wall and the nail hem itself; while the gripping portions impart fatigue resistance to overcome a possible weakening effect if successive panels, once locked, are disengaged for any reason.

Further, the new, improved panel is fabricated so that a greater percentage of material is effective in surface coverage.

Further still, the new, improved panel permits ease in installation and positive locking of adjacent panels while permitting adjustment of the panels laterally during installation. The panel, also, serves to support sections of insulation on the inner surface of the material facing the wall, which insulation acts against a portion of a lower panel of successive courses providing resistance to movement of currents of air.

The new, improved panel accordingly overcomes the various problems and disadvantages of the prior art and the features and advantages of the present invention, discussed above, will become more readily apparent from the following detailed description of the invention considered with the appended drawings.

BEST MODE FOR CARRYING OUT THE INVENTION

Figure 1:
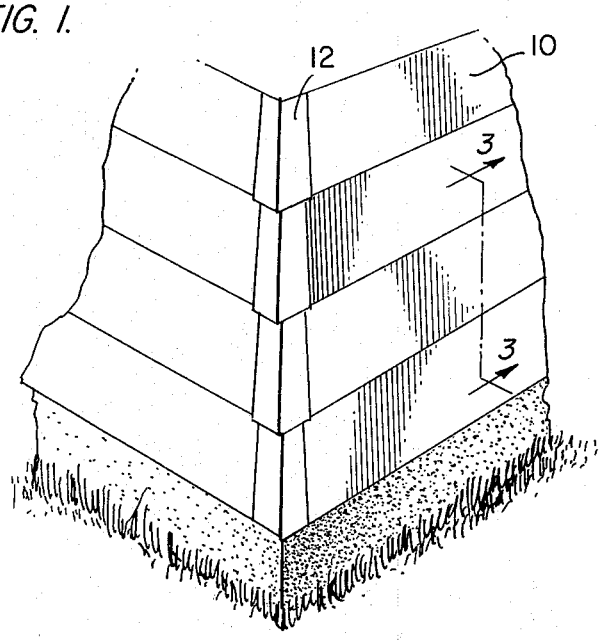
FIG. 1 illustrates in partial perspective the panel of the present invention applied as siding on an existing structure.

FIG. 1 illustrates a panel 10 locked to adjacent panels in a plurality of courses on an existing structure and a corner member 12 overlapping each course at the edges. Panel 10 includes a face 14 or surface covering portion having an overlapping first edge 16 folded with a terminally disposed gripping portion 18. The overlapping first edge 16 defines a nail hem 20 and includes a plurality of slots 22 for receiving a nail 24 (FIG. 3) during installation. The slots are of elongated, oval outline having their major dimension located parallel to the overlapping first edge. The size and positioning of the slots are conventional.

Figure 3:
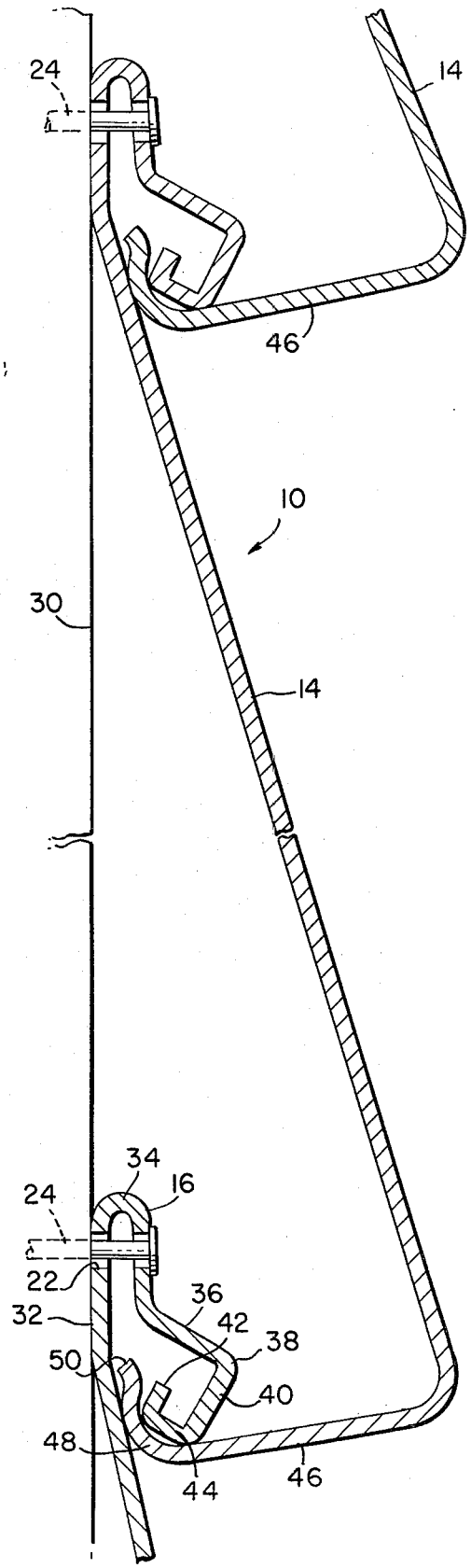
FIG. 3 illustrates in greater detail the details of the gripping portions of the panel of FIG. 1 taken along section lines 3—3 in that FIG.

An edge 26 or second edge, disposed oppositely of the first edge, yet connected to the first edge by the face 14, includes a flange 28, also comprising a gripping portion. The flange is formed by an arcuately configurated, upwardly directed length of material for interaction with the gripping portion 18 of a panel in a lower course to lock the successive courses. The association of gripping portions is illustrated in FIG. 3. In the Figure, a panel 10 of one course is illustrated locked to a panel 10' of a lower course in the mounting of siding to an existing structure which may be a wall 30. Both panels are illustrated as including a surface 32 within the region of the first edge for better support of the panel on the wall. The first edge, more particularly, is configurated with a closed loop 34 formed as an inverted bend providing double thickness of material at nail hem 20. The slots 22 for receipt of nails in securement overlie one another and are coextensive.

Figure 2:
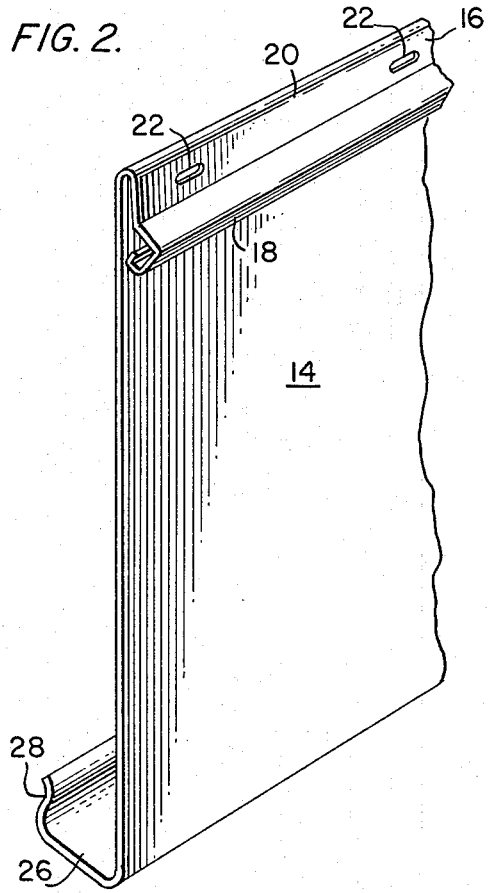
FIG. 2 is a partial perspective view of one form of panel of the present invention.

The panel of FIGS. 2 and 3 provides a gripping portion 18 formed by a flange 36 which extends downwardly and outwardly (away from wall 30) from the nail hem 20 toward a knuckle 38 from which it extends downwardly and inwardly to define a leg 40. The gripping portion 18 is further defined by a second leg 42 connected to leg 40 by a member 44. The gripping portion 18 extends along the length of panel 10 and, as described, is configurated to that of a rectangle or square with the portions thereof substantially enclosing the inner space.

With further reference to FIG. 3, the gripping portion 28 is illustrated to terminate in a slightly arcuately inverted terminal portion 50. And, the second edge extends throughout a distance so that the gripping portion 28 will extend substantially to the surface of the panel of the lower course which may be angled away from wall 30 by about a few degrees.

Figure 4:
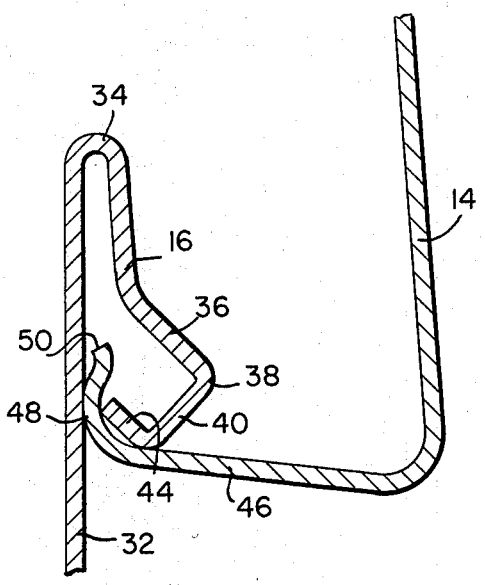
FIG. 4 is a partial side elevational view illustrating a slight modification of panel and gripping portions.

FIG. 4 illustrates a panel 10*a* which generally is similar in configuration to that of panel 10 (FIG. 3) except that second leg 42 is not included. Nevertheless, the gripping portion, discussed herein as configurated in the form generally of a loop, is completed throughout a substantial major extent of a closed loop. In the modified panel of FIG. 4 as well as the modification of FIG. 5 and the second form of panel of FIGS. 6 and 7, the face 14 is integral with edge 26 which correspondingly includes a flange 28 (or 64') having an arcuately inverted terminal portion 50. The flange or gripping portion is illustrated juxtaposed to surface 32 which may be similarly configurated to that of the embodiment of FIG. 3 with closed loop 34 and overlapping first edge 16.

Figure 5:
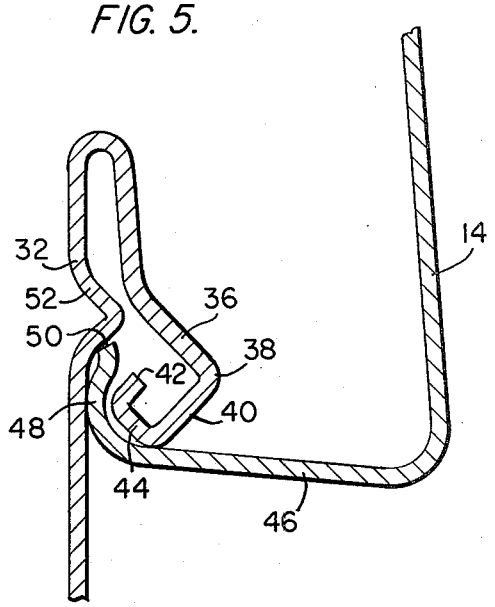
FIG. 5 is a partial side elevational view illustrating a further modification of panel and gripping portions.

A further modification of panel comprised of panel 10*b* is illustrated in FIG. 5. The modified panel includes a gripping portion 18 and differs from the panel of FIG. 3 in that the surface 32*b* is formed with a bend 52 concave toward wall 30. The bend provides a degree of strengthening within the region of the surface and, further, provides a terminating surface for terminal portion 50 of gripping portion 28.

Figure 6:
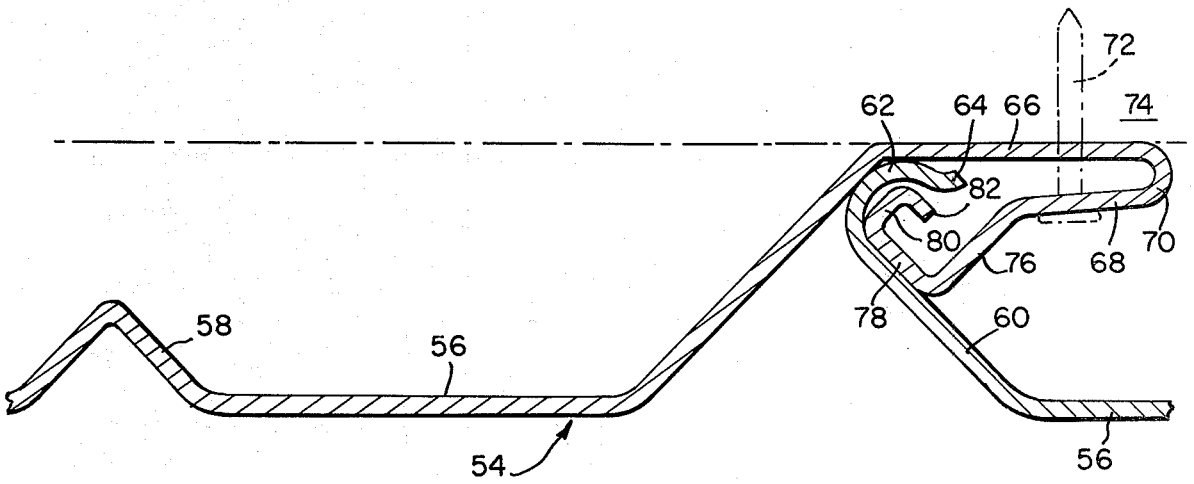
FIGS. 6 and 7 are partial side elevations of a second form of panel of the present invention illustrating details of the gripping portions and alternative dispositions of insulation; and, FIG. 8 illustrates, in side sectional view, the panel of the present invention applied as a soffit on an existing structure.
Figure 6:
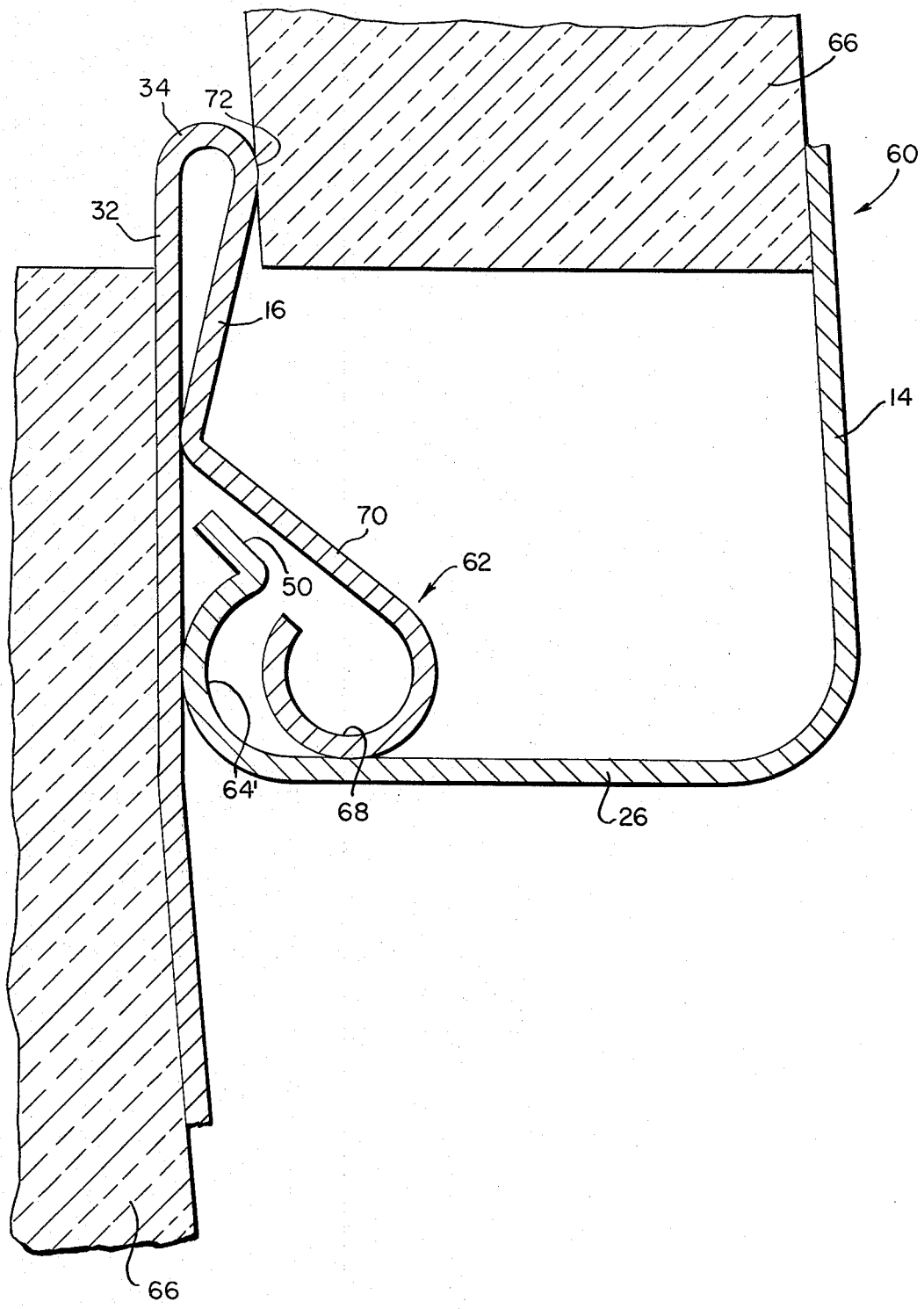
Figure 7:
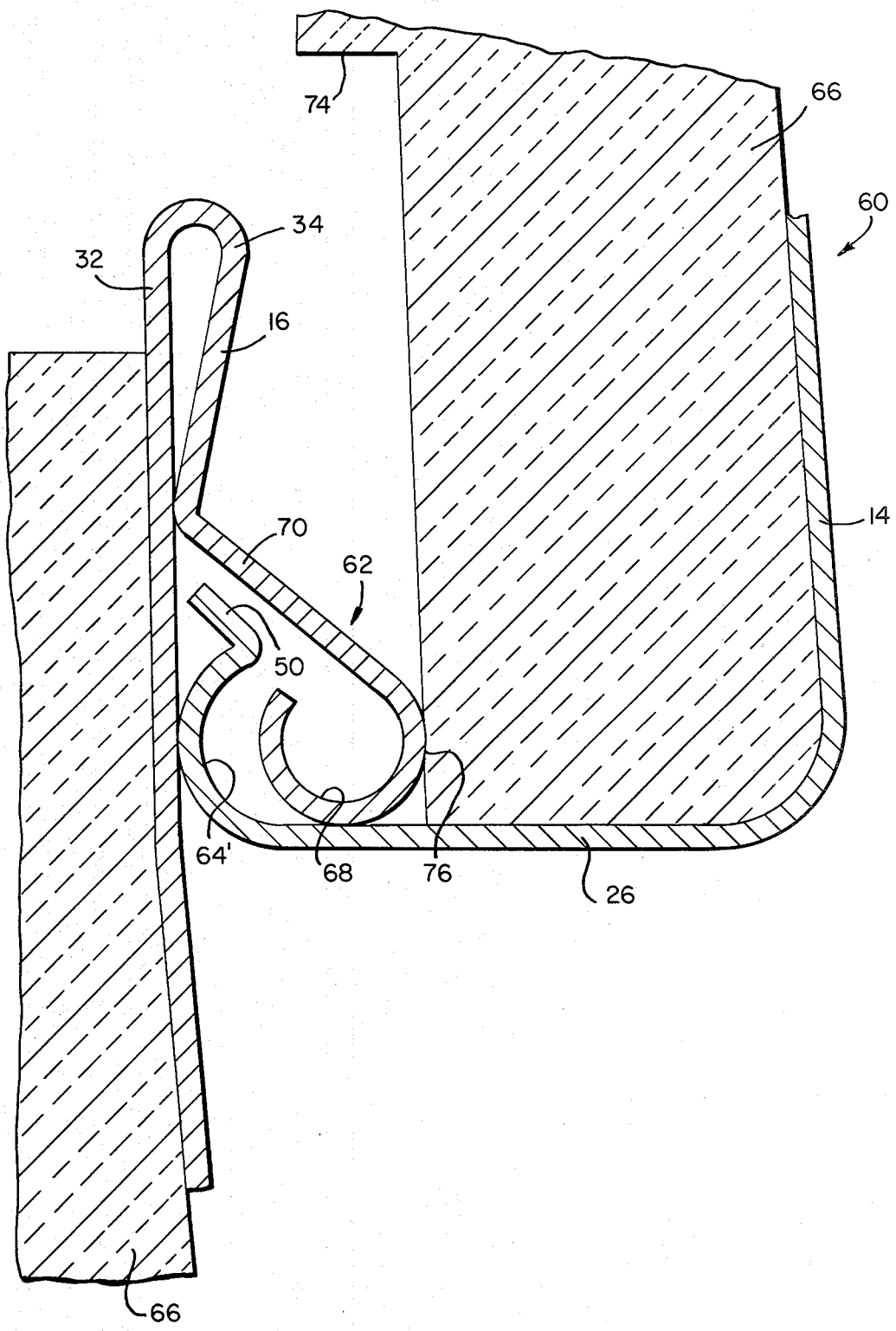

Turning to FIGS. 6 and 7, there is illustrated a second form of panel 60 of the present invention. The panel, overall, is rather similar to the panel illustrated in FIG. 3 and, accordingly, like or similar structure is similarly identified.

Panel 60 similarly may be locked to adjacent panels in a plurality of courses on an existing structure, such as the surface 30 of FIG. 1 with a corner member 12 overlapping each course at the edges. Panel 60 includes a face 14 or surface covering portion having an overlapping first edge 16 folded with a terminally disposed gripping portion 62. The overlapping first edge defines a nail hem and includes a plurality of slots (not shown) for receiving a nail (also not shown) during installation. As previously described, the size and positioning of the slots are conventional.

An edge 26 or second edge, disposed oppositely of the first edge, yet connected to the first edge by the face 14, includes a flange 64, also comprising a gripping portion. The flange is formed by an arcuately configurated, upwardly directed length of material for interaction with the gripping portion 62 of a panel in a lower course to lock the successive courses as is illustrated in FIGS. 6 and 7. In the Figures, a panel 60 of one course, a higher course, is illustrated locked to a similar panel of a lower course in the mounting of siding to an existing structure, such as the wall previously described. Both panels are illustrated as including a surface 32 within the region of the first edge for better support of the panel on the wall and better support of the upper surface area of an insulative layer 66. The insulative layer may be formed of any suitable material used in construction, such as backerboard, having a thickness of about 0.5 inch (0.0125 mm). The insulative layer may be adhered to the surface of the panel 60, facing the wall to which it ultimately is mounted, by any conventional building adhesive.

The first edge, more particularly, is configurated with a loop 34 formed as an inverted bend providing double thickness of material at the nail hem.

The gripping portion 62 is configurated as a substantially closed loop 68 providing an extension of a downwardly and outwardly directed leg 70. As may be seen in FIGS. 6 and 7, the loop 68 of gripping portion 62 continues throughout a substantial major extent of a closed loop to a point of termination, preferably along one radius of curvature and the flange 64 of the other gripping member extends throughout an arc to the point from which the leg 50 or termination extends toward the surface 32. The radius of curvature of the flange 64 is greater than that of loop 68. This construction serves at least two major functions which have been briefly considered above. Firstly, the surface of flange 64, at or within the location of leg 50, is capable of interacting with the region of the termination of loop 68 with a bite thereby to preliminarily stabilize the panel of the upper course vertically on the panel of the lower course before the first-mentioned panel is supported on the wall 30 or other building structure by nails received through the slots. Further, and this applies to the panel of the generic invention, the two uncomplementary surfaces of the gripping portion results in the development of less sliding friction since the area of engaging surfaces is less. Accordingly, the installer is able to readily adjust the lateral position of the panel of the upper course relative to the panel of the lower course in installation.

As a further aspect of the invention, each panel may carry insulation in the form of backerboard, for example, on the surface of the panel facing wall 30. In FIG. 6, the insulation is illustrated as extending throughout a distance from a point approximately 0.125 inch (0.003 mm) below the top of loop 34 to a position spaced somewhat from the second edge 26. Thus, the insulation of a panel of an upper course extends to at least the plane of the insulation of the panel of the lower course. The insulative layer preferably will have parallel surfaces and the surface closer to the wall will interact along a bearing point 72 within the region of the nail hem providing a wind rib.

In the form illustrated in FIG. 7, the insulative layer extends to the surface of the second edge. In this form, a notch 74 is cut along the lower length of the insulative layer 66 and the bearing point 76, and similarly a wind rib is found along the gripping portion 62. The insulative layer preferably extends above the slots in the nail hem so that the nails pass therethrough in installation. The notch may begin slightly above the top of fold 34 and may be cut to a dimension of about 0.125 inch (0.003 mm). The dimensions are set out solely for purposes of illustration and not in a limiting sense, for clearly, the panel may be of any particular dimension, as required.

FIG. 8 illustrates a soffit panel 54 which may be secured to the eaves of existing building structures and includes the gripping portions of the present invention. This construction includes a surface portion 56 having an aesthetic and strengthing indentation 58 which joins at one end to an edge 60 having an inwardly arcuately shaped flange or gripping portion 62 terminating as an inverted portion 64. A surface 66 having a nail hem 68 formed similarly to the nail hem of FIG. 3 provides support for the soffit panel on an existing surface 74. The nail hem includes a plurality of slots for the receipt of nails 72 and terminates in an outwardly and downwardly projecting flange 76. The flange is integral with base member 78 which forms a square "U"-shaped configuration with adjacent legs 80 and 82. This structure provides a gripping portion like that of the gripping portion 18 of FIG. 3.

By practice of the present invention, a number of important advantages will be readily apparent over existing structures commercially available. Thus, instead of the material ending at the top of the nail hem, the nail hem is formed from a double thickness of material which terminates in a gripping portion. This configuration of nail hem having double thickness effectively strengthens the fastening of the panel to the wall and the panel itself.

By way of illustration, because of the improved configuration of panel, it is possible to use an appropriate 9.6-inch wide strip to produce a panel which covers an 8-inch wide section. Thus, 83.4% of the metal is utilized for the functional purpose of covering the wall, and only 16.6% of the strip width is required to fasten the panel on the wall and secure panel-to-panel continuity. This results in approximately 10% less material per unit area of wall covered, with a resultant savings in energy which would have been required to produce the excess material.

The amount of material per unit is decreased, the unit weight of material is decreased by a corresponding 10%, thus reducing transportion costs of the material.

Along with the decrease in weight is a decrease in volume size per unit, thus decreasing the amount of space required to store the product. Also, a larger amount of material can be stored in a given area, reducing inventory expenses.

The gripping portions 18, 28 (and 62, 64) are configurated in the form generally of loops to impart fatigue resistance to the structure. This permits the disengagement of the panel of one course from that of a lower course, yet at the same time the structure maintains that degree of resiliency and rigidity required for snap-fitting. The configuration of gripping portion 18 (and 62) resists damage during installation and, even when such damage is effected, in most instances, the damage proves harmless in receiving the flange or gripping portion 28 (and 64) for securing the successive courses of panels. To this end, as may be apparent, damage may result from striking the gripping portions 18 (and 62) of the panels instead of hammering nail 24 into the wall 30. The configuration of the gripping portions resists collapse and thereby maintains the ability to lock the successive courses of panel.

The present configuration also provides a convenient means for metal-to-metal contact by simply not supplying a coating around the elements serving as the contact members of the lock. Thus, a convenient lightning arresting system can be achieved which may thereafter be effectively grounded to arrest lightning.

The panel herein described is not limited to any one base material, but may be fabricated from any current materials utilized to produce panels, for example, aluminum, vinyl or steel, or any future materials developed for use in the production of panels providing an ultimate use as a siding panel, soffit panel or panel for other construction use.

From the foregoing, it will be readily apparent to those skilled in the art that various modifications and changes may be effected therein without departing from the practice of the presently disclosed invention.

I claim:

1. A panel construction having a surface covering face, an overlapping first edge therealong folded over to provide a double thickness and having a terminally disposed gripping portion, said double thickness of said first edge providing a nail hem having a plurality of slots evenly spaced along and through both thicknesses of said nail hem for receiving installation nails, and a second edge oppositely disposed to said first edge, said second edge also having a terminally disposed gripping portion for mating engagement with said first-mentioned gripping portion in the securement of a panel of an upper course with a panel of a lower course of panels when said second-mentioned gripping portion is entered through an opening between said first-mentioned gripping portion and said surface covering face into a pocket, said first-mentioned gripping portion formed to a loop extending throughout a substantial major extent of a closed loop and terminating in a bite portion toward said surface covering face of said lower panel for interacting with the second-mentioned gripping portion of said upper panel when received in said pocket, said first and second-mentioned gripping portions having dissimilar contours thereby to reduce surface friction between gripping portions and permit sliding adjustment of a panel of an upper course on a panel of a lower course.

2. The panel of claim 1 wherein said gripping portion at said first edge is formed by a loop of substantially constant radius.

3. The panel of claim 1 wherein said gripping portion at said first end is formed by a loop of substantially rectangular outline.

4. The panel of claim 1, or 2, or 3 further including an insulative layer providing resistance to air flow between said panel and a structure upon which said panel is supported, said insulative layer being adhered to said surface covering face at least along a major portion of its width and throughout its length, and said insulative layer having a thickness sufficient to extend into bearing engagement along a portion of panel of a lower course of panels.

5. The panel of claim 4 wherein said bearing engagement is along said nail hem.

6. The panel of claim 4 wherein said bearing engagement is along said gripping portion at said first end.

7. The interconnecting locking-joint construction of claim 1 wherein the nail hem is configurated with an outwardly and downwardly projecting flange forming a knuckle member along with a projecting leg member which is inwardly disposed and forms approximately a square U configuration with a second leg member and a base member.

8. The interconnecting locking-joint construction of claim 1 wherein the nail hem surface includes an inwardly projecting band disposed along the back surface thereof as a strengthening element for the wall support surface.

9. The interconnecting locking-joint construction of claim 1 configurated for installation as a siding.

10. The interconnecting locking-joint construction of claim 1 configurated for installation as a soffit.

11. The soffit of claim 10 wherein the surface portion includes an aesthetic and strengthening indentation disposed along an intermediate portion thereof.

* * * * *